United States Patent [19]

Hirose et al.

[11] 3,943,906

[45] Mar. 16, 1976

[54] INTAKE SYSTEM FOR AN INTERNAL COMBUSTION ENGINE

[75] Inventors: Yutaka Hirose; Sadao Isomura, both of Hiroshima, Japan

[73] Assignee: Toyo Kogyo Co., Ltd., Japan

[22] Filed: July 9, 1974

[21] Appl. No.: 486,823

[30] Foreign Application Priority Data

July 9, 1973 Japan ..... 48-81791[U]

[52] U.S. Cl. ..... 123/179 G; 123/127; 261/41 C; 261/23 A; 261/39 D

[51] Int. Cl.[2] ..... F02N 17/00

[58] Field of Search ..... 123/127, 119 F, 179 R, 123/179 A, 179 G; 261/41 C, 23 A, 39 R, 39 A, 39 B, 39 D

[56] References Cited

UNITED STATES PATENTS

| | | | |
|---|---|---|---|
| 2,053,094 | 9/1936 | Markham | 123/179 A |
| 2,193,533 | 3/1940 | Kishline et al. | 261/23 A |
| 2,323,442 | 7/1943 | Beard | 123/127 |
| 3,205,879 | 9/1965 | Von Seggern et al. | 123/127 |
| 3,608,533 | 9/1971 | Mennesson | 123/179 A |

FOREIGN PATENTS OR APPLICATIONS

| | | | |
|---|---|---|---|
| 1,125,966 | 11/1956 | France | 123/127 |
| 27,571 | 7/1924 | France | 123/127 |

*Primary Examiner*—Charles J. Myhre
*Assistant Examiner*—James D. Liles
*Attorney, Agent, or Firm*—Fleit & Jacobson

[57] ABSTRACT

In an internal combustion engine having at least two separated combustion chambers and at least two separated intake passages respectively connected with said combustion chambers, a communicating passage is provided between the intake passages and shut-off valve means is provided in the intake passages except one intake passage. The shut-off valve means is closed during engine starting and warming up period so that intake air is introduced only through said one intake passage whereby intake flow speed is increased to improve atomization of fuel.

6 Claims, 7 Drawing Figures

INTAKE SYSTEM FOR AN INTERNAL COMBUSTION ENGINE

The present invention relates to an internal combustion engine and more particularly to an intake system for an internal combustion engine having a plurality of separated combustion chambers.

In an engine having a plurality of separated combustion chambers, it has been known to use a carburetor having a plurality of passages or barrels for supplying intake air separately into the combustion chambers. A two-stage carburetor used for this purpose has pairs of air passages or barrels, each pair including primary and secondary passages. The primary passages are used throughout the engine operation and the secondary passages are used in addition to the primary passages during high load engine operation.

Such an engine that has a carburetor of the aforementioned type is started by opening throttle valves for the primary barrels to a predetermined angle so that intake air is introduced through the primary passages into the associated combustion chambers. However, since intake air is allowed to pass all of the primary passages, it is difficult to attain sufficient air flow speed of such a degree that a satisfactory atomization of fuel can be ensured. Thus, it is difficult to raise temperature of exhaust gas cleaning means very rapidly so that the exhaust gas cleaning means comes into operation with a high efficiency immediately after engine start.

In order to solve the above problem, it has been proposed to provide an auxiliary carburetor so as to improve atomization of fuel and perform engine warm-up under a relatively high engine speed. This arrangement is disadvantageous, however, in view of the fact that the structural arrangement of fuel and air intake system becomes complicated.

Therefore, the present invention has an object to provide means for facilitating fuel atomization in an engine having a plurality of separated combustion chambers during engine start.

Another object of the present invention is to provide means for increasing intake air flow speed during engine start so that fuel atomization is facilitated and engine exhaust gas temperature can be increased.

A further object of the present invention is to provide an intake system for an internal combustion engine having a plurality of separated combustion chambers, in which only one of intake passages is opened so as to supply intake air into all of the engine combustion chambers.

The above and other objects of the present invention can be attained by an intake system for an internal combustion engine having at least two separated combustion chamber means, said intake system including first intake passage means having first throttle valve means and venturi means, second intake passage means having second throttle valve means and venturi means, means for connecting said first and second intake passage means respectively with said combution chamber means, communicating passage means for connecting said first and second intake passage means at portions downstream sides of said throttle valve and venturi means, shut-off valve means provided in said second intake passage means between said throttle valve means and said communicating passage means, means for opening said throttle valve means of said first intake passage means to a first predetermined opening and closing said shut-off valve means during engine starting and warming-up period, and means for returning said throttle valve means of the first intake passage means to a second predetermined opening which is smaller than said first predetermined opening and simultaneously opening said shut-off valve means after engine warming-up is completed. According to a preferred aspect of the present invention, auxiliary shut-off valve means is provided in said communicating passage means, and closed during normal operation of the engine so that the combustion chamber means do not have mutual influence.

The above and other objects and features of the present invention will become apparent from the following descriptions of preferred embodiments taking reference to the accompanying drawings, in which:

FIG. 1*a* is a longitudinal sectional view of the engine intake system showing a basic concept of the present invention;

FIG. 1*b* is a cross-sectional view of the engine intake system shown in FIG. 1*a;*

Figure 1A:
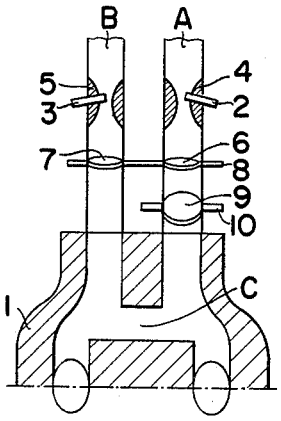
Figure 1B:
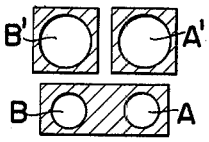

Referring now to the drawings, particularly to FIGS. 1*a* and 1*b*, there is schematically shown an intake system having a four barrel type two-stage carburetor. The intake system includes two primary barrels or passages A and B and two secondary barrels or passages A′ and B′. As shown in FIG. 1*a*, the passages are connected with an intake manifold housing 1. The passage A has a main fuel nozzle 2 opening to the passage at a venturi portion 4 formed therein. Similarly, the passage B includes a main fuel nozzle 3 provided at a venturi portion 5. The passages A and B have throttle valves 6 and 7 which are interconnected with each other by an actuating rod 8. According to a feature of the present invention, the passage A is further provided with a shut-off valve 9 which is operated by an acutating rod 10 between a closed and an open positions. Further, in the manifold housing 1, the passages A and B are connected with each other by a communicating passage C.

In normal operation, the shut-off valve 10 is in fully open position and intake fuel-air mixture is taken into engine through the passages A and B. Under a heavy load condition, additional mixture is also taken into the engine through the passages A′ and B′ as well known in the art. According to the feature of the present invention, during starting and warming-up period of the engine, the shut-off valve 10 is closed and the throttle valve 7 is opened to a first predetermined opening. Thus, air is introduced into all combustion chambers of the engine only through the passage B. Therefore, sufficient air flow speed can be ensured in the passage B even at time of engine start, so that satisfactory atomization of fuel can be attained. After engine warming-up is completed, the shut-off valve 9 is opened.

Figure 2:
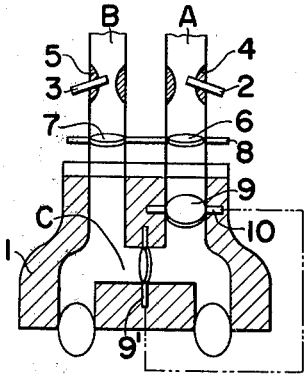
FIG. 2 is a schematic sectional view similar to FIG. 1*a* but showing a modified form of the present invention.

The arrangement shown in FIG. 2 is substantially the same as that in FIG. 1 but, in FIG. 2, a second shut-off valve 9′ is provided in the communication passage C. The second shut-off valve 9′ is interconnected with the first shut-off valve 9 so that the former is opened when the latter is closed and vice versa. In this arrangement, since the communicating passage C is closed during normal operation of the engine, any mutual influence among the combustion chambers can be avoided. It is of course possible to actuate the second shut-off valve 9′ independently from the first shut-off valve 9.

Figure 3:
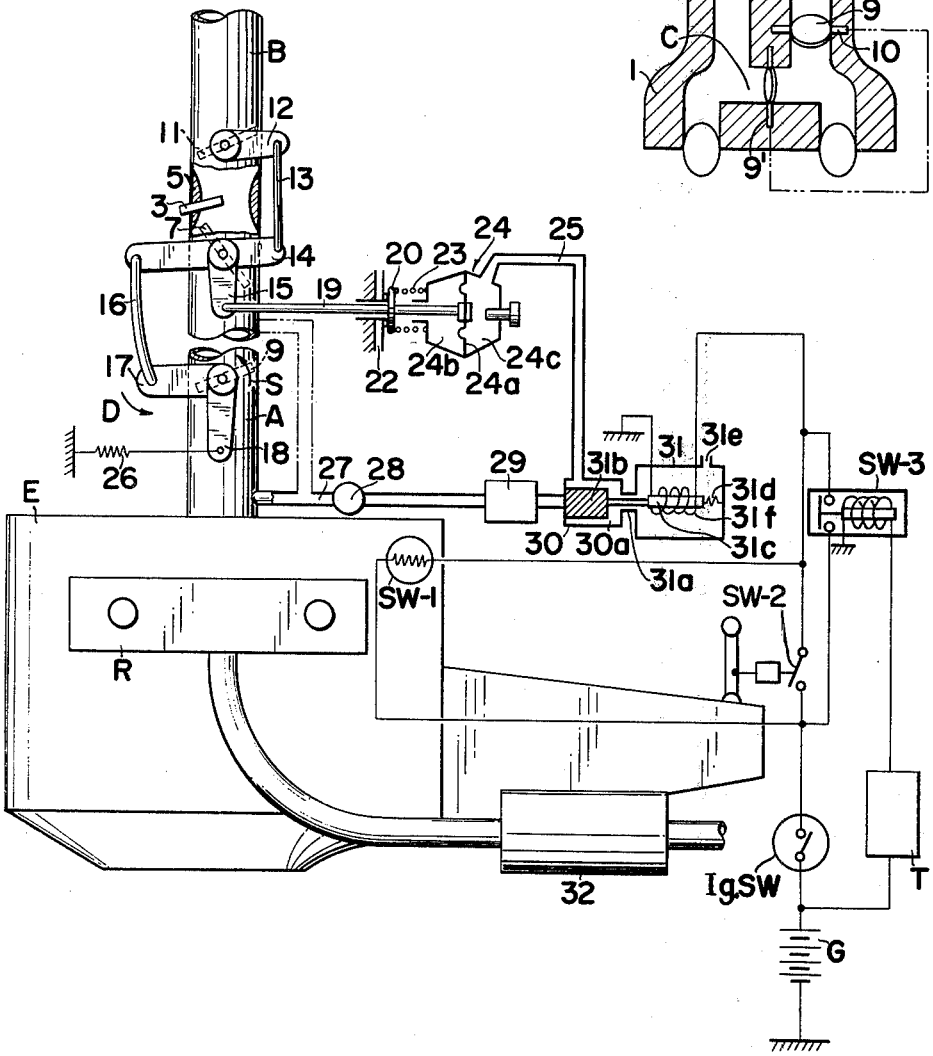
FIG. 3 is a schematic view of an engine intake system in accordance with one embodiment of the present invention.

In FIG. 3, there is shown an engine intake system embodying the feature of the present invention and including intake passages A and B for introducing combustible mixture into separated combustion chambers of an engine E. As described previously, the passage B includes a main fuel nozzle 3 provided at a venturi portion 5 thereof and a throttle valve 7. A choke valve 11 is also provided in the passage B and connected in certain relationship with the throttle valve actuating lever 14 through a lever 12 and a connecting rod 13 as well known in the art. The throttle valve 7 also has an L-shaped lever 15 secured thereto. One end of the lever 15 is connected through a connecting rod 16 with a lever 17 which is secured to the shut-off valve 9 in the passage A, so that the shut-off valve 9 is closed when the throttle valve 7 is opened. The connection between the throttle valve 7 and the shut-off valve 9 is such that, in response to an opening movement of the throttle valve 7 toward a first predetermined opening, the shut-off valve 9 is moved to a closed position and, when the throttle valve 7 is moved to a second predetermined opening which is smaller than the first predetermined opening, the shut-off valve 9 is moved to a substantially fully open position. The first predetermined position is so determined that sufficient intake air is allowed to pass into the combustion chambers through the passage B for warming up the engine. The shut-off valve 9 is also provided with a lever 18 which is connected with a spring 26 whereby the valve 9 is biased to closing direction.

The other end of the lever 15 is connected through a push-pull rod 19 with a diaphragm type actuating means 24 which includes a diaphragm 24*a* to define in the actuating means 24 an atmospheric pressure chamber 24*b* and a vacuum chamber 24*c*. The diaphragm 24*a* is connected with an end of the push-pull rod 19. The rod 19 is provided with a disc 20 which receives a spring 23 disposed between the disc 20 and the diaphragm means 24 so as to urge the rod 19 toward left. A stopper 22 is provided for determining the extreme left position of the rod 19. Thus, it will be understood that, when negative pressure is introduced into the chamber 24*c*, the push-pull rod 19 is moved toward right to close the throttle valve 7.

The vacuum chamber 24*c* is connected through a conduit 25 with a valve 30 which is in turn connected through a vacuum reservoir 29, a check valve 28 and a conduit 27 with the intake passage A at the downstream side of the shut-off valve 9. The valve 30 has a chamber 30*a* which is connected through a port 31*a* with a solenoid chamber 31 opened to the atmosphere through a port 31*e*. In the valve chamber 30*a*, there is disposed a valve member 31*b* which is actuated by a solenoid having a armature 31*c* and a coil 31*f*. The valve member 31*b* is biased toward left by means of a spring 31*d* to interrupt communication between the valve chamber 30*a* and the vacuum reservoir 29 and, when the solenoid is energized, it is displaced toward right and open the vacuum chamber 24*c* to the vacuum reservoir 29 simultaneously closing the port 31*a*. The solenoid coil 31*f* is connected through a main ignition switch IgSW and a thermo-switch SW-1 with an electric power source G. The thermo-switch SW-1 is disposed in such a position that the temperature of engine cooling water or an engine exhaust gas cleaning device 32 is sensed, and closed when the temperature reaches a predetermined value. A so-called neutral switch SW-2 is provided in parallel with the switch SW-1. The switch SW-2 is normally closed but opened when transmission of vehicle is shifted to the neutral position. A time delay switch SW-3 which is controlled by a timer T is also disposed in the circuit in parallel with the switches SW-1 and SW-2. The switch SW-3 is normally closed but opened only for a predetermined time interval, for example 20 minutes after engine start. In an alternative arrangement, the switch SW-3 may be closed when the engine speed reaches a predetermined value, for example 1400 rpm. It should also be noted that one or two of the switches SW-1, SW-2 and SW-3 may be omitted.

In operation, the main ignition switch IgSW is closed and the engine is started with the choke valve 11 closed and the throttle valves in the passages A and B and the shut-off valve 9 in the positions shown in FIG. 3. Thus, intake air is supplied to all of the engine combustion chambers only through the passage B. When the engine warming up is completed, the thermo-switch SW-1 is closed to energize the solenoid coil 31*f*, whereby the valve member 31*b* is shifted toward right to introduce a suction pressure in the vacuum chamber 24*c*. Thus, the push-pull rod 19 is moved toward right to turn the throttle valve in a closing direction until a second predetermined opening is attained. At the same time, the shutter valve 9 is opened. Thereafter, intake air is introduced through both of the intake passages A and B. During normal operation of the engine, the opening of the throttle valve is manually controlled so as to provide a desired engine output without effecting the position of the shut-off valve 9. For this purpose, a mechanism similar to those employed in the arrangements of FIGS. 4 through 6 may be used between the actuating rod of the throttle valve 7 and the lever 15.

Figure 4:
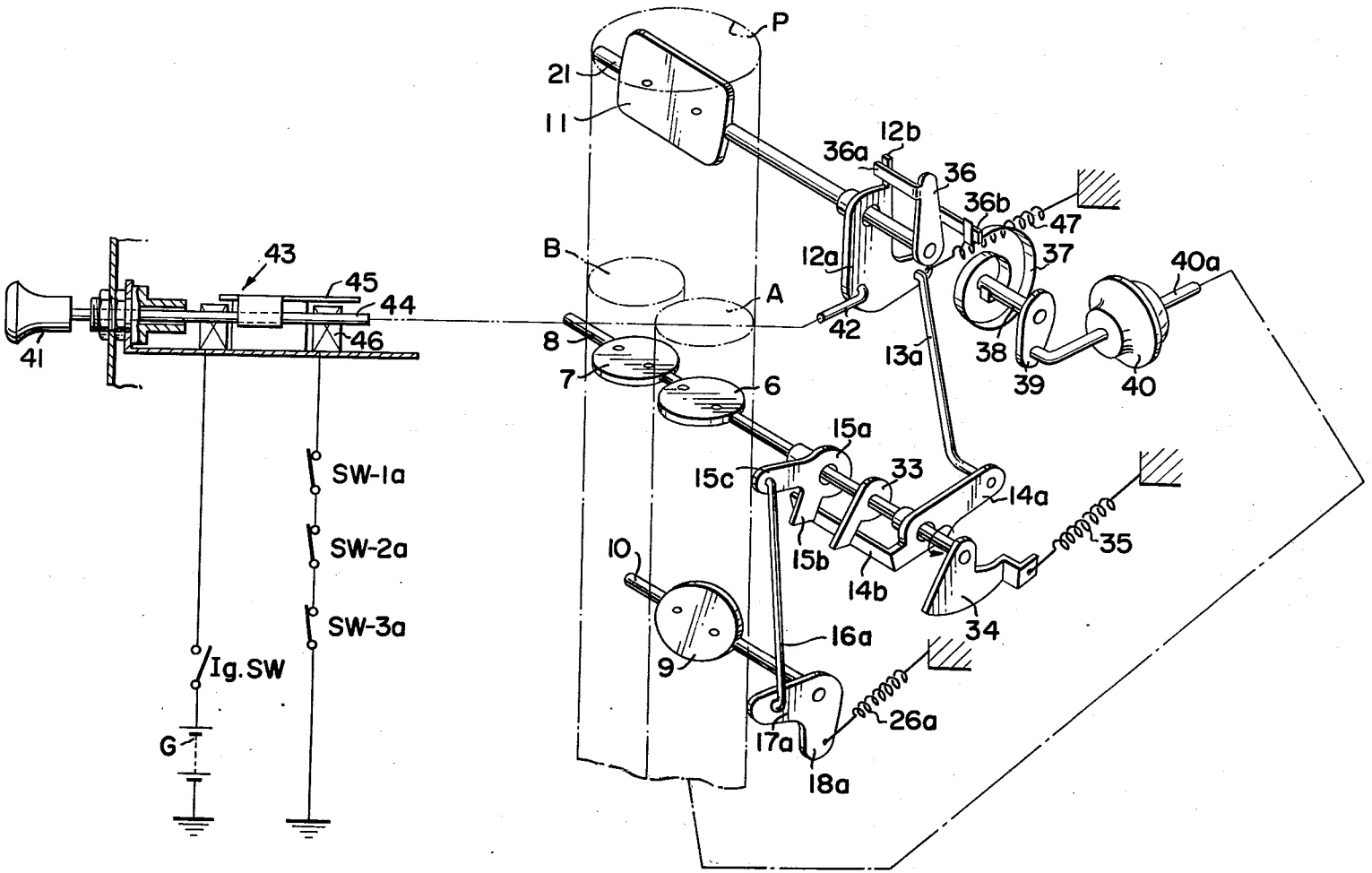
FIG. 4 is a perspective view showing another embodiment of the present invention.

Referring now to FIG. 4 which shows another embodiment of the present invention, there is shown an engine intake system including intake passages A and B. As in the previous embodiment, the passages A and B are respectively provided with throttle valves 6 and 7 which are secured to a common shaft 8. In the passage A, there is further provided a shut-off valve 9 which is connected with an actuating shaft 10. The shaft 8 has a radially projecting lug 33 at an intermediate portion and a lever 34 secured to one end thereof. The lever 34 is adapted to be connected with a manually operated member such as an accelerating pedal (not shown) of a vehicle on which the engine is mounted, so that the position of the throttle valves 6 and 7 can be manually controlled as desired. A spring 35 is provided between the lever 34 and a stationary portion of the vehicle so as to bias the shaft 8 in the direction shown by an arrow in the drawing to maintain the throttle valves 6 and 7 at a second predetermined position. The passages A and B are connected with a common intake passage P in which a choke valve 11 is disposed. The choke valve 11 has a shaft 21 secured thereto and having a lever 36 at one end. The lever 36 has a lug portion 36*a* extending parallely to the shaft 21 toward the choke valve 11 and a second lug portion 36b extending toward the opposite side of the lug portion 36a. The lug portion 36b is connected with one end of a bimetal element 37, the other end of the element 37 being connected with a rotatable rod 38 which has a lever 39 connected with a diaphragm device 40. The diaphragm device 40 is connected through a conduit 40a with the passage A at the downstream side of the shut-off valve 9, or with the passage B at the downstream side of the throttle valve 7. An L-shaped lever 12a is rotatably mounted on the shaft 21 and connected at an intermediate portion thereof with an end of a wire 42, the other end of the wire 42 being connected with a rod 44 having a choke valve operating knob 41. The lever 12a has a lug portion 12b formed at one end thereof for abutting engagement with the lug portion 36 *a* of the lever 36. The other end of the lever 12a is connected with one end of a spring 47 which is secured at the other end to a stationary part of the vehicle. Thus, the lever 12a is normally biased counterclockwise as shown by an arrow in the drawing and this bias force is transmitted through the lever 36 to the shaft 21 to normally maintain the choke valve 11 in open position. When the knob 41 is actuated to pull the rod 44 and the wire 42, the lever 12a is rotated clockwise against the influence of the spring 47. Then, due to the nature of the bimetal element 37, the lever 36 is also rotated clockwise to move the choke valve 11 to the closed position.

In order to hold the rod 44 in the choke valve close position, a holding mechanism 43 is provided. The mechanism 43 includes a metal plate 45 secured to the rod 44 and a solenoid 46 adapted to co-operate with the metal plate 45. The solenoid 46 is connected on one hand through a main ignition switch IgSW with an electric power source G and on the other hand grounded through switches SW-1*a*, SW-2*a* and SW-3*a*. It should be understood that the switches SW-1*a*, SW-2*a* and SW-3*a* are of normally closed type but serves functions corresponding to the switches SW-1, SW-2 and SW-3 in the previous embodiment. Thus, when the choke valve actuating knob 41 is pulled toward left in the drawing and the ignition switch IgSW is closed, the solenoid 46 is energized and hold the plate 45 and therefore the rod 44 in the choke valve close position. Then, when either one of the switches SW-1*a*, SW-2*a* and SW-3*a* is opened, the solenoid 46 is de-energized and the rod 44 is allowed to return rightwardly.

The throttle valve shaft 8 rotatably carries a stopper lever 14a which has a stopper lug portion 14b extending from one end thereof parallely with the shaft 8. The other end of the lever 14a is connected through a connecting rod 13a with the lever 12a, so that when the lever 12a is rotated clockwise by pulling the knob 41 the rod 13a is moved downwardly and the lever 14a is also rotated in clockwise direction. The lug portion 33 on the shaft 8 engages with the stopper lug portion 14b on the lever 14a so that, when the lever 14a is rotated clockwise as described previously, the shaft 8 is also rotated clockwise to open the throttle valves 6 and 7 to a first predetermined opening which is larger than the second predetermined opening.

On the throttle valve shaft 8, there is rotatably mounted a lever 15a having a lug 15b for engagement with the stopper lug portion 14b. The lever 15a also has an arm 15c which is connected through a push-pull rod 16a with a lever 17a secured to an end of the shut-off valve shaft 10 so that, when the lever 14a is rotated clockwise, the lever 15a and thus the lever 17a is also rotated clockwise to close the shut-off valve 9. A spring 26a is provided between an arm 18a on the lever 17a and a stationary part of the vehicle so that the shut-off valve 9 is normally biased in opening direction.

In operation, the main switch IgSW is closed and the knob 41 is pulled leftwardly. Then the knob 41 is held in the left position by the solenoid 46. The lever 12a is then rotated clockwise to turn the lever 14a in the same direction. Thus, the choke valve shaft 21 is allowed to rotate clockwise under the influence of the bimetal element 37 to close the choke valve 11 and at the same time the throttle valves 6 and 7 are opened to the first predetermined opening. Further, the shut-off valve 9 is closed through the lever 15a, the rod 16a and the lever 17a. Therefore, intake air is supplied to all combustion chambers only through the passage B. When the engine is started and a suction pressure prevails in the intake passage B at the downstream side of the throttle 7, the diaphragm device 40 serves to rotate the rod 38 counterclockwise. Thus, the choke valve 11 is returned to the open position.

When either one of the switches SW-1*a*, SW-2*a* ans SW-3*a* is opened, the solenoid 46 is de-energized to release the knob 41 and the rod 44. The lever 12a is thus rotated counterclockwise under the influence of the spring 47 to turn the lever 14a counterclockwise. Then, the throttle valve shaft 8 is allowed to rotate under the influence of the spring 35 until the throttle valves 6 and 7 are moved to the second predetermined position. At the same time, the shaft 10 is rotated under the action of the spring 26a to open the sut-off valve 9. It should also be noted that in the arrangement of FIG. 4, the knob 41 may be manually returned to open the shut-off valve 9 and return the throttle valves 6 and 7 to the second predetermined opening.

Figure 5:
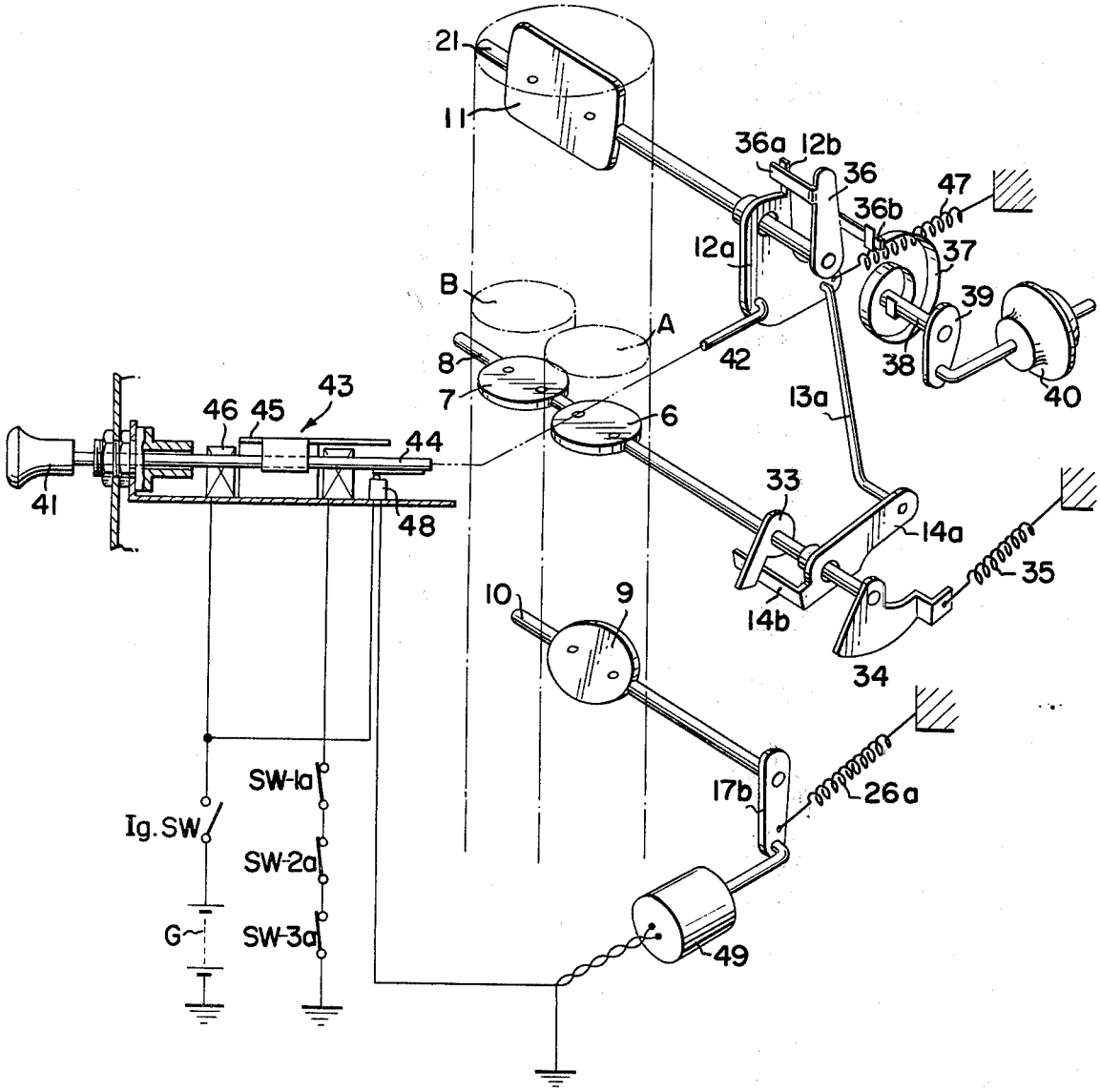
FIG. 5 is a perspective view similar to FIG. 4 but showing another embodiment of the present invention.

FIG. 5 shows a further embodiment of the present invention which is different from the embodiment in FIG. 4 in that the shut-off valve 9 is actuated by a solenoid 49. For this purpose, the shut-off valve shaft 10 has a lever 17b secured to one end thereof and the armature of the solenoid 49 is connected to the lever 17b. The electric power source G is connected with the solenoid 49 through a normally open switch 48 which is closed when the knob 41 is pulled. The operation of the arrangement in FIG. 5 is similar to that in the arrangement of FIG. 4 so that further descriptions will not be necessary.

Figure 6:
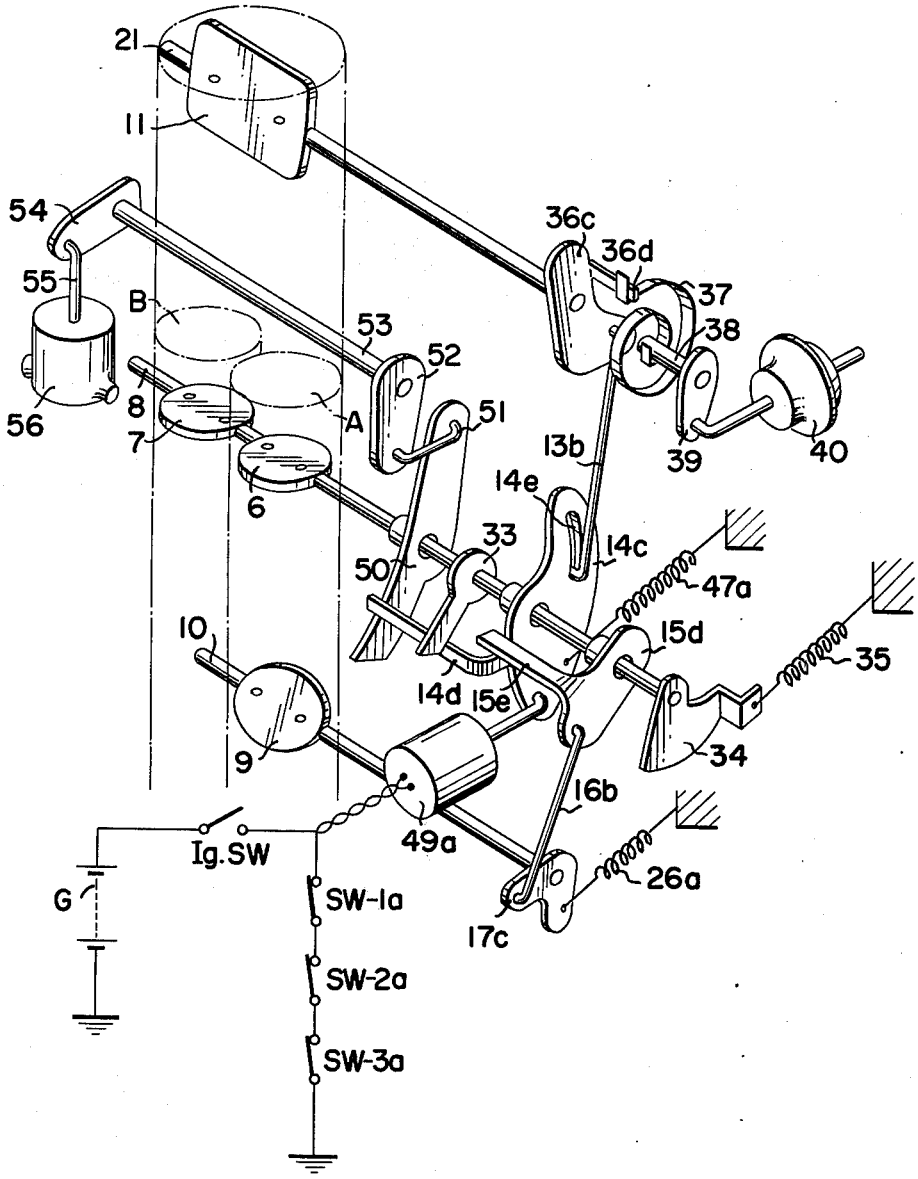
FIG. 6 is a perspective view similar to FIGS. 4 and 5 but showing a further embodiment of the present invention.

In FIG. 6, there is shown a mechanism in which the concept of the present invention is applied to an engine intake system having an automatic choke valve control means. In the arrangement, the choke valve shaft 21 has a lever 36c with a lever 14c which is rotatably mounted on the throttle valve shaft 8. As shown in the drawing, the lever 14c has a slot 14e and the free end of the rod 13b is in engagement with the slot 14e. As in the previous embodiment, the lever 36c has a lug 36d which engages with the bimetal element 37. The lever 14c has a stopper lug 14d which is adapted to engage with the stopper 33 on the throttle valve shaft 8. A throttle position control lever 50 is mounted rotatably on the shaft 8 and engages with the lug 14d on the lever 14c so as to determined the position of the lever 14c. The control lever 50 is connected through a rod 51, a lever 52, a shaft 53, a lever 54 and a push-pull 55 with a throttle position controller 56 for determining the throttle position at the second predetermined opening. This opening of the throttle valves 6 and 7 can be adjusted by moving the rod 55 to rotate the lever 50 through the aforementioned linkage. The throttle position controller 56 may be of such a type that adjusts the position of the lever 50 in accordance with the temperature of the engine cooling water or the like. On the throttle valve shaft 8, there is also rotatably mounted a shut-off valve control lever 15*d* which has a lug 15*e* for engagement with the lug 14*d* on the lever 14*c* so that it is rotated with the lever 14*c* when the latter is rotated clockwise. In normal position, the lug 15*e* is not always in engagement with the lug 14*d* for the purpose that any adjusting movement of the controller 56 does not affect on the opening position of the shut-off valve 9. The lever 15*d* is connected through a rod 16*b* with a lever 17*c* secured to the shut-off valve shaft 10. A solenoid 49*a* is operatively connected with the lever 14*c* and energized by the electric power source G through a circuit including a main ignition switch IgSW and normally closed switches SW-1*a*, SW-2*a* and SW-3*a*.

In operation, the ignition switch IgSW is closed to energize the solenoid 49*a*. Then, the lever 14*c* is rotated clockwise with the result that the throttle valve shaft 8 and the shut-off valve shaft 10 are rotated clockwise to open the throttle valves 6 and 7 to the first predetermined opening and simultaneously close the shut-off valve 9. As the lever 14*c* rotates clockwise, the lever 36*c* is allowed to rotate clockwise under the influence of the bimetal element 37 so as to close the choke valve 11. As the engine temperature increases and/or suction pressure is produced in the intake passage, the bimetal element 37 and/or the diaphragm device 40 serve to move the choke valve 11 toward opening direction. Since the rod 13*b* engages with the lever 14*c* through the slot 14*e*, this movement of the choke valve 11 does not have any effect on the positions of the throttle valves 6 and 7 and the shut-off valve 9.

When either one of the switches SW-1*a*, SW-2*a* and SW-3*a* is opened, the solenoid 14*c* is de-energized and the lever 14*c* is allowed to rotate counterclockwise under the influence of the spring 47*a*. Thus, the throttle valves 6 and 7 are returned to the second predetermined positions and the shut-off valve 9 is opened.

From the above descriptions, it will be understood that, in accordance with the present invention, in an internal combustion engine have a plurality of separated combustion chambers supplied with combustible mixture through a plurality of intake passages, only one of the passages is used to supply mixture to all of the combustion chambers during engine starting and warming up period, so that the flow speed of mixture can be increased to obtain better atomization of fuel. This feature further provides a further advantage that the exhaust gas temperature can be increased contributing to an improved efficiency of exhaust gas cleaning device.

We claim:

1. Intake system for an internal combustion engine having at least two separated combustion chamber means, said intake system including first intake passage means having first throttle valve means and venturi means, second intake passage means having second throttle valve means and venturi means, means for connecting said first and second intake passage means respectively with said combustion chamber means, communicating passage means for connecting said first and second intake passage means at portions downstream sides of said throttle value and venturi means, shut-off valve means provided in said second intake passage means between said throttle valve means and said communicating passage means, means for opening said throttle valve means of said first intake passage means to a first predetermined opening and closing said shut-off valve means during engine starting and warming-up period, and means for returning said throttle valve means of the first intake passage means to a second predetermined opening which is smaller than said first predetermined opening and simultaneously opening said shut-off valve means after engine warming-up is completed.

2. Intake system in accordance with claim 1 in which auxiliary shut-off valve means is provided in said communicating passage means, means being further provided for opening said auxiliary shut-off valve means during the engine starting and warming-up period and closing the auxiliary shut-off valve means after engine warming-up is completed.

3. Intake system in accordance with claim 1 which further comprises means for detecting operating condition of the engine and controlling said throttle valve means and said shut-off valve means in accordance with the engine operating condition.

4. Intake system in accordance with claim 3 which further comprises choke valve means and in which said detecting means is a means for detecting position of operating mechanism of said choke valve means.

5. Intake system in accordance with claim 3 in which said detecting means includes means for sensing engine temperature.

6. Intake system in accordance with claim 1 which further includes means for operating said last mentioned means after a predetermined time from engine start.

* * * * *